US005879218A

United States Patent [19]

Tao

[11] Patent Number: 5,879,218

[45] Date of Patent: Mar. 9, 1999

[54] BUBBLE MAKING APPARATUS AND METHOD

[75] Inventor: Masahiro Tao, Kawagushi, Japan

[73] Assignee: Cap Toys, Inc., Bedford Heights, Ohio

[21] Appl. No.: 869,375

[22] Filed: Jun. 5, 1997

Related U.S. Application Data

[63] Continuation of Ser. No. 577,428, Dec. 22, 1995, abandoned.

[51] Int. Cl.[6] ..... A63H 33/28

[52] U.S. Cl. ..... 446/15; 446/19

[58] Field of Search ..... 446/17–21, 15

[56] References Cited

U.S. PATENT DOCUMENTS

| | | | |
|---|---|---|---|
| 770,288 | 9/1904 | Horton | 446/19 |
| 2,452,794 | 11/1948 | Saachy | 446/16 X |
| 2,553,388 | 5/1951 | Steiner et al. | 446/21 |
| 3,443,337 | 5/1969 | Ehrlich | 446/19 |
| 5,238,437 | 8/1993 | Vowles et al. | 446/15 |

*Primary Examiner*—Robert A. Hafer
*Assistant Examiner*—Laura Fossum
*Attorney, Agent, or Firm*—Laff, Whitesel, Conte & Saret, Ltd.

[57] ABSTRACT

A bubble making apparatus and method for producing an orderly chain of simply connected large bubbles. Bubble forming vents are provided into a bubble forming chamber at one end of a bubble forming tube. Bubbles propagate along the tube and are expelled through a bubble outlet port as a chain of bubbles with the aid of air flow through bubble propulsion vents. The chain of bubbles is supported by air flow from an air outlet port disposed below the bubble outlet port.

16 Claims, 5 Drawing Sheets

BUBBLE MAKING APPARATUS AND METHOD

This is a continuation of prior application Ser. No. 08/577,428, filed Dec. 22, 1995 abandoned.

FIELD OF THE INVENTION

This invention relates generally to devices for making bubbles and in particular to an electrically operated bubble making machine, and is more particularly directed toward an apparatus and method for forming and supporting a chain of connected bubbles.

BACKGROUND OF THE INVENTION

The earliest bubble making device has been known for centuries, and simply consists of a surface containing an opening, most frequently a hoop or ring, that can be dipped into an appropriate bubble forming solution (liquid soap, for example). Surface tension causes the bubble solution to form a film that stretches across the opening, and a bubble is readily formed and expelled from the opening in response to the user blowing gently on the film in a direction perpendicular to the plane of the opening.

Of course, this bubble blowing device most often serves as a toy for small children, and like many other toys, has been updated over the years in the wake of progressing technology. There is hardly a toy available that has not been improved through electronic or other means to produce the same results as manually operated toys of days gone by, and these technologically improved toys enjoy widespread popularity. Children of today demand toys that are active rather than passive in nature, and the market has responded with a wide variety of electronic and electromechanical toy products.

There are many examples of mechanized bubble blowing devices, some operated by battery power, that can produce many more bubbles than a simple manual bubble blowing device of the type just described. The deft user of the simple bubble blowing toy can produce many special effects with bubbles, and among the favorites is the construction of a chain of bubbles, sometimes involving competitions centering around the production of the longest chains.

There are mechanized devices available that can produce limited chains or garlands of bubbles, but these have the disadvantage of producing their garlands from a massive volume of very small bubbles, or requiring manual intervention by the operator to produce viable chains of simply connected large bubbles.

Accordingly, a need arises for an electrically operated bubble making toy that will produce lengthy chains of relatively large, simply connected bubbles without requiring the manual intervention of the user.

SUMMARY OF THE INVENTION

These needs and others are satisfied by the bubble making apparatus of the present invention. The bubble making apparatus comprises a bubble forming tube having a bubble outlet port through which a chain of connected bubbles is expelled, and an air outlet port positioned below the bubble forming tube through which a stream of air is directed substantially parallel to the bubble forming tube and in the direction of bubble expulsion, such that the chain of connected bubbles is supported by the stream of air from the air outlet port upon exit from the bubble outlet port. The bubble forming tube includes a bubble forming chamber at a first end and a bubble outlet port at a second end.

In one form of the invention, the bubble forming chamber is defined at least in part by a transverse partition in the bubble forming tube. The transverse partition may comprise a plate disposed within the bubble forming tube. The stream of air is provided by a fan in communication with the air outlet port, and the fan may be driven by an electric motor. Preferably, the electric motor is battery powered.

In one embodiment of the invention, the bubble making apparatus comprises a bubble forming tube having a bubble forming chamber at a first, proximal end, and a bubble outlet port at a second, distal end, through which a chain of connected bubbles is expelled, a bubble solution reservoir operatively connected to the bubble forming chamber via a bubble solution feed aperture, a fan coupled to an air duct, the air duct communicating with the bubble forming chamber via bubble forming vents, a plurality of bubble propulsion vents in communication with the air duct, and an air outlet port positioned below the bubble forming tube through which a stream of air is directed substantially parallel to the bubble forming tube and in the direction of bubble expulsion, such that a chain of connected bubbles is expelled from the bubble outlet port via air flow through the bubble forming vents and bubble propulsion vents, and the chain of connected bubbles is supported by the stream of air from the air outlet port upon exit from the bubble outlet port. The bubble forming chamber is defined at least in part by a transverse partition in the bubble forming tube. Preferably, the bubble forming vents are disposed below and adjacent to the bubble solution feed aperture.

In accordance with another aspect of the invention, a control valve may be interposed between the bubble solution reservoir and the bubble forming chamber. The fan may be driven by an electric motor that is preferably battery powered.

In accordance with the invention, a method is provided for producing a chain of connected bubbles. The method comprises the steps of providing a bubble forming tube having a bubble forming chamber at a first end and a bubble outlet port at a second end, providing bubble forming vents into the bubble forming chamber through which air is directed to form connected bubbles within the bubble forming tube, providing a plurality of bubble propulsion vents in communication with the bubble forming tube such that a chain of connected bubbles is expelled from the bubble outlet port, and providing an air outlet port positioned below the bubble forming tube through which a stream of air is directed, such that the chain of connected bubbles is supported by the stream of air from the air outlet port upon expulsion from the bubble outlet port. The step of providing bubble forming vents into the bubble forming chamber comprises providing two openings into the bubble forming chamber disposed below and adjacent to the bubble solution feed aperture. The step of providing a plurality of bubble propulsion vents in communication with the bubble forming tube comprises providing two openings adjacent and above the bubble solution feed aperture, the openings in communication with a fan via an air duct, such that streams of air are directed through the openings to aid in expelling a chain of connected bubbles from the bubble outlet port.

In another form of the invention, a bubble making apparatus is provided that comprises means for forming bubbles proximate to a first end of a bubble forming tube, means for expelling a chain of connected bubbles from a second end of the bubble forming tube, and means for supporting the chain of connected bubbles upon expulsion. The means for forming bubbles comprises a bubble forming chamber defined at least in part by a transverse partition in the bubble forming tube, and a plurality of bubble forming vents connecting the bubble forming chamber and a fan through an air duct, such that air directed through the bubble forming vents forms bubbles from bubble solution disposed in the bubble forming chamber. The means for expelling a chain of connected bubbles comprises a plurality of bubble propulsion vents in communication with the bubble forming tube, the bubble propulsion vents communicating with a fan via an air duct, such that streams of air directed through the bubble propulsion vents aid in expelling the chain of connected bubbles from a bubble outlet port proximate the second end of the bubble forming tube. The means for supporting the chain of connected bubbles upon expulsion comprises an air outlet port positioned below the bubble forming tube through which a stream of air is directed, such that the chain of connected bubbles is supported by the stream of air from the air outlet port upon expulsion.

DETAILED DESCRIPTION OF THE INVENTION

In accordance with the present invention, a bubble making apparatus and method are described that provide distinct advantages when compared to those of the prior art. The invention can best be understood with reference to the accompanying drawing figures.

Figure 1:
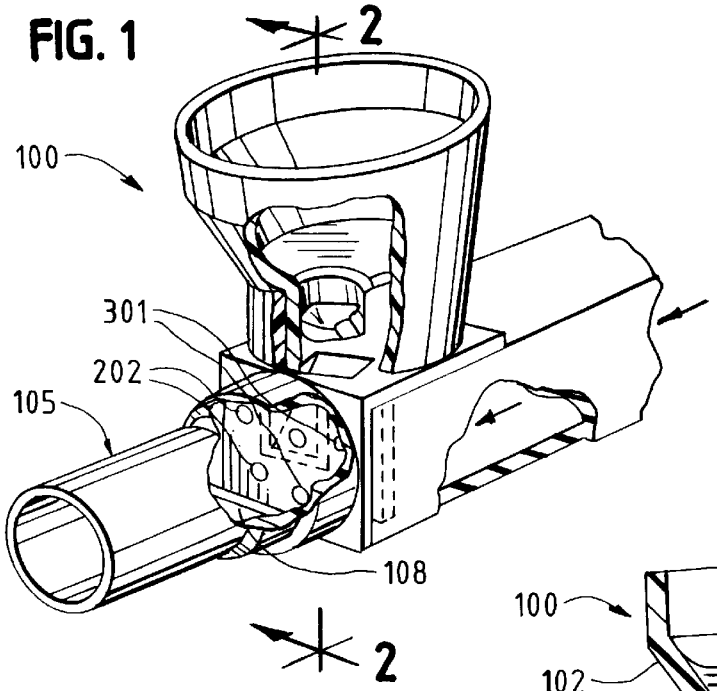
FIG. 1 is a left front perspective view of a portion of a bubble making apparatus in accordance with the present invention.
Figure 2:
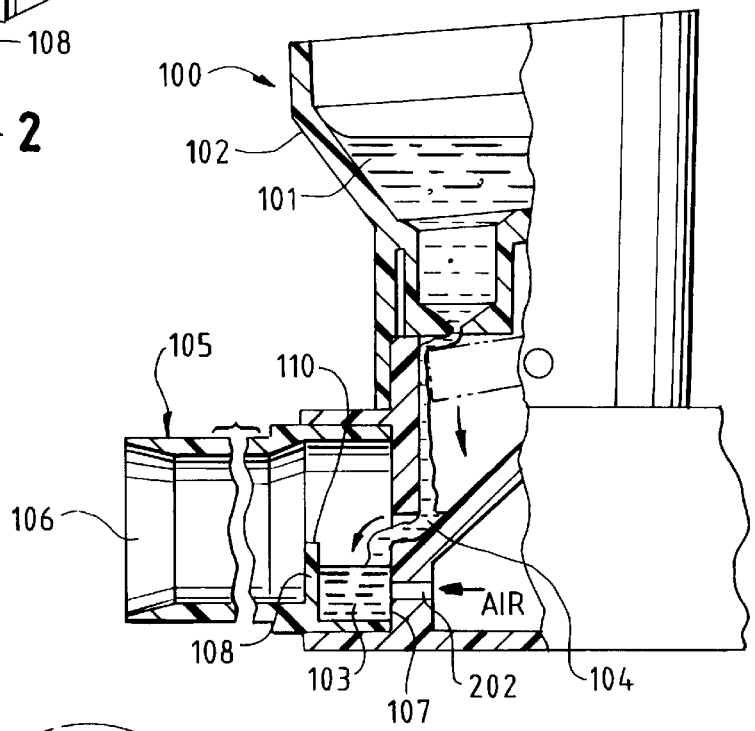
FIG. 2 is a side section view taken along section lines 2—2 of FIG. 1.

FIG. 1 is a left front perspective view of a bubble making apparatus 100 in accordance with the present invention, with several areas cut away in order to reveal interior details. FIG. 2 is a side section view taken along section lines 2—2 of FIG. 1. In operation, a bubble forming solution 101, such as a liquid soap, for example, is delivered from a bubble solution reservoir 102 to a bubble forming chamber 103 by a bubble solution feed aperture 104. The bubble forming chamber 103 is positioned at a first, proximal end of a bubble forming tube 105, and is defined by a front wall 107 of the bubble solution reservoir assembly 109 and a transverse partition 108 in the bubble forming tube 105. The partition 108 may be a plate of metal or other suitable material, formed into a semicircle, for example, and installed in the bubble forming tube 105 at an appropriate position. The partition 108 may also be integrally formed during manufacture of the bubble forming tube 105, such as in a plastic molding operation. In the alternative, the partition 108 could be molded in place. In any case, a bubble outlet port 106 is provided at a second, distal end of the bubble forming tube 105.

Figure 3:
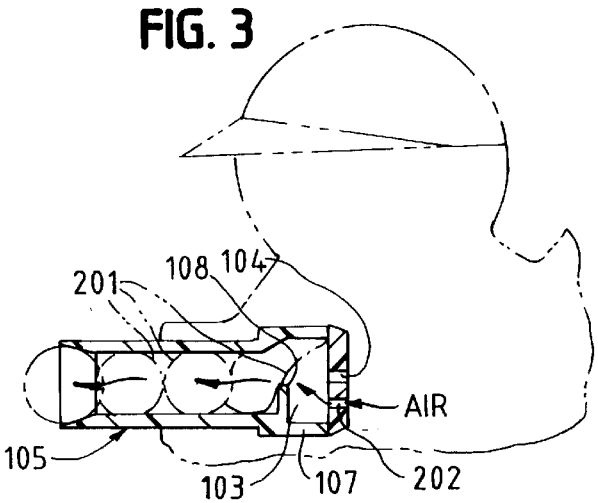
FIG. 3 is a partial section view of the bubble forming tube illustrated in FIGS. 1 and 2.

FIG. 3 is a partial section view of the bubble forming tube 105, and serves to illustrate the manner in which bubbles are formed. Bubble forming vents 202 are provided through the front wall 107 of the bubble solution reservoir assembly 109 near the bottom surface of the bubble forming chamber 103. Air is directed through the bubble forming vents 202 in a fashion that will be described subsequently.

The air directed through the bubble forming vents 202 causes a film of bubble solution to advance from a position near the bottom of the bubble forming chamber 103 such that the film of bubble solution eventually stretches from the partition 108 to the walls of the bubble forming tube 105. Provided that the quantity of bubble forming solution in the bubble forming chamber 103 and the velocity of the air flow through the bubble forming vents are properly regulated, films 201 of bubble solution will be continuously formed within the bubble forming tube 105 and will propagate down the tube 105 toward the bubble outlet port 106 in response to the incoming air flow.

Figure 4:
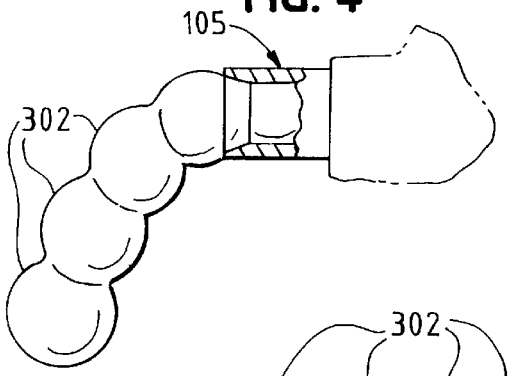
FIG. 4 depicts a chain of connected bubbles exiting the bubble outlet port of the bubble making apparatus of FIG. 2.

FIG. 4 depicts a chain of connected bubbles 302 exiting the bubble outlet port 106 of the bubble making apparatus 100. This orderly expulsion of simply connected large bubbles 302 is accomplished by directing additional air streams from bubble propulsion vents 301 disposed above the bubble forming vents 202 and above the top 110 of the partition 108 that defines the bubble forming chamber 103. The specific fashion in which these air streams are provided will be explained in detail subsequently.

It has been determined empirically that without the air streams from the bubble propulsion vents 301, connected bubbles 302 tend to coil about the exterior surface of the bubble forming tube 105 rather than emerging in a well-defined chain as shown. The air streams from the bubble propulsion vents 302 tend to expel the bubbles 302 from the bubble forming tube 105, so it can be said that a chain of bubbles is expelled from the bubble outlet port 106 via air flow through the bubble forming vents 202 and bubble propulsion vents 301. The air flow through the bubble forming vents 202 and the bubble propulsion vents 301 causes the successively produced films of bubble forming solution to propagate down the bubble forming tube 105 and exit from the bubble outlet port 106 as a well-ordered chain of connected bubbles, rather than coiling about the bubble forming tube 105.

Figure 5:
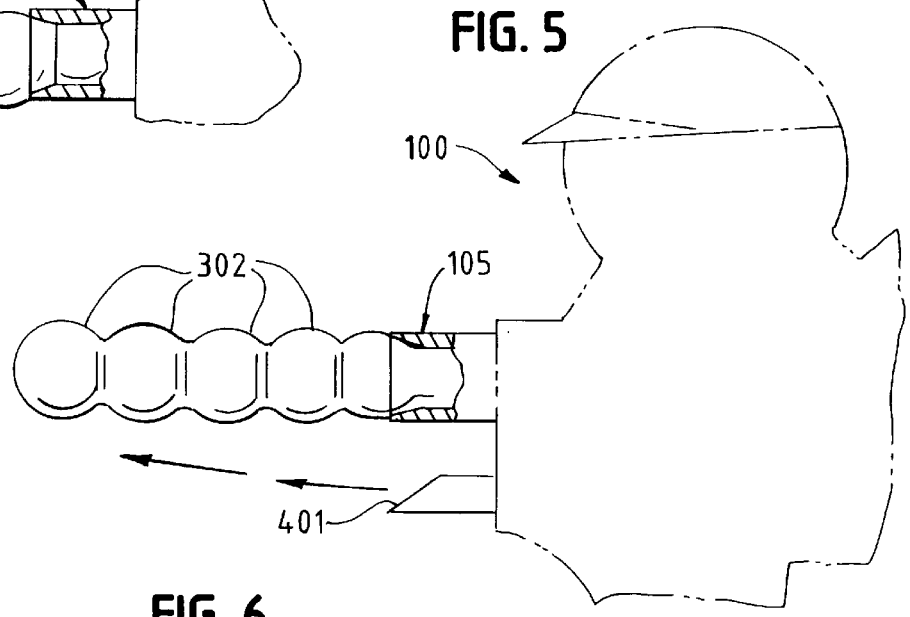
FIG. 5 illustrates a chain of connected bubbles supported by a stream of air from an air outlet port.

FIG. 5 illustrates yet another aspect of the present invention. It has also been determined empirically that even if a well-ordered chain of bubbles 302 is successfully expelled from the bubble outlet port 106, the chain of bubbles 302 will begin to bend down upon exit, as illustrated in FIG. 4, thus detracting from the pleasing chain effect. To counteract this downward-bending tendency, an air outlet port 401 is positioned below the bubble forming tube 105. A stream of air is directed through the air outlet port 401 (in a fashion to be described in detail below) substantially parallel to the bubble forming tube 105 and in the same direction as bubble expulsion, to provide support for the chain of bubbles 302 so that the chain does not tend to bend downward, but instead extends for some distance parallel to the bubble forming tube as it exits the bubble outlet port, thus prolonging the pleasing bubble chain effect.

Figure 6:
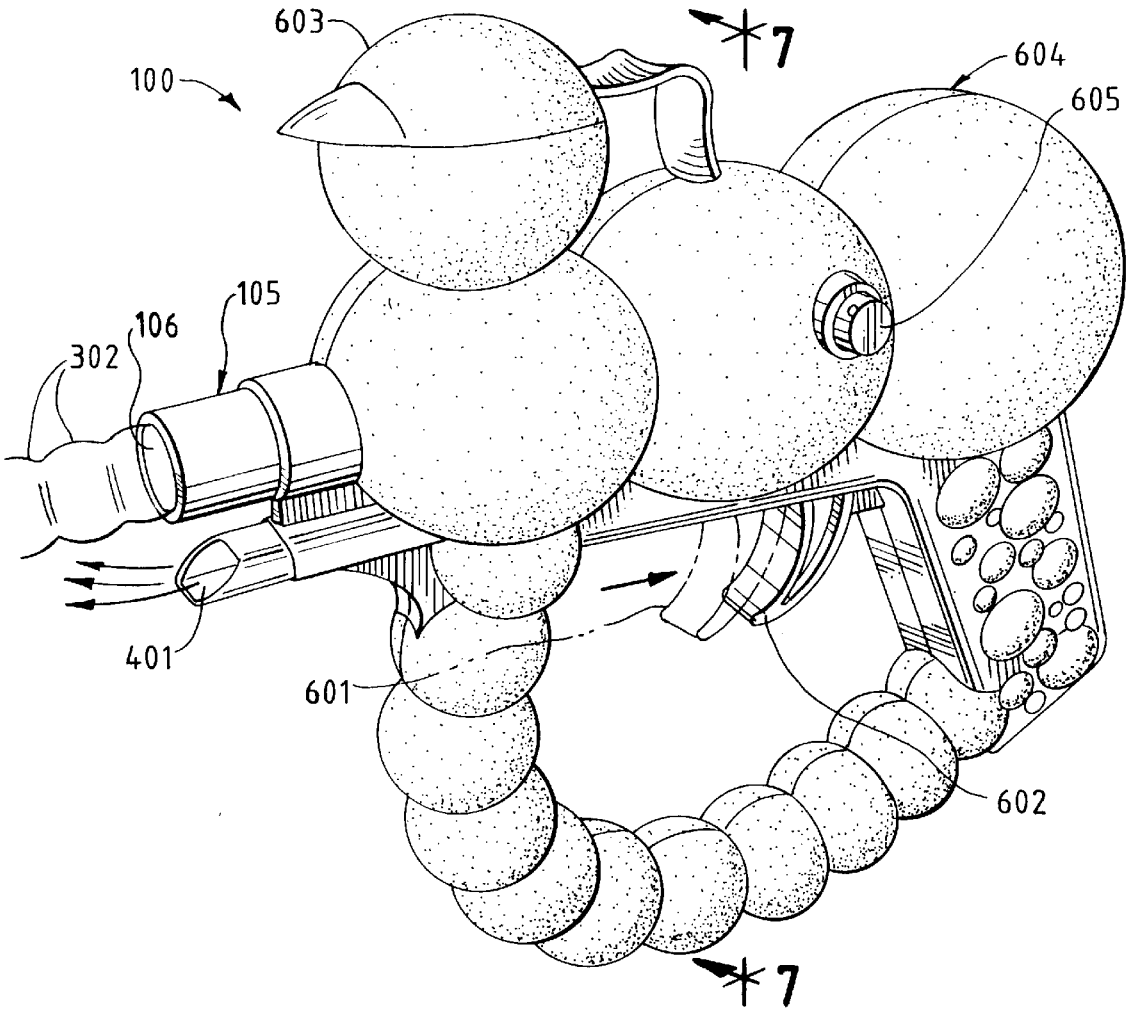
FIG. 6 is a front left perspective view of a bubble making apparatus in accordance with the present invention in an ornamental housing.

FIG. 6 is a front left perspective view of a toy embodying the bubble making apparatus 100 within a housing 604. A chain of simply connected large bubbles 302 is shown exiting the bubble outlet port 106 at the end of the bubble forming tube 105. The chain of bubbles 302 is supported by air flow through the air outlet port 401.

The toy depicted in FIG. 6 is equipped with a trigger 601. When the trigger 601 is pulled back by the user to a second position 602, the bubble making apparatus is activated in a fashion that will be described subsequently. The toy also includes a cover 603 that helps to prevent spillage of the bubble forming solution from the solution reservoir.

Figure 7:
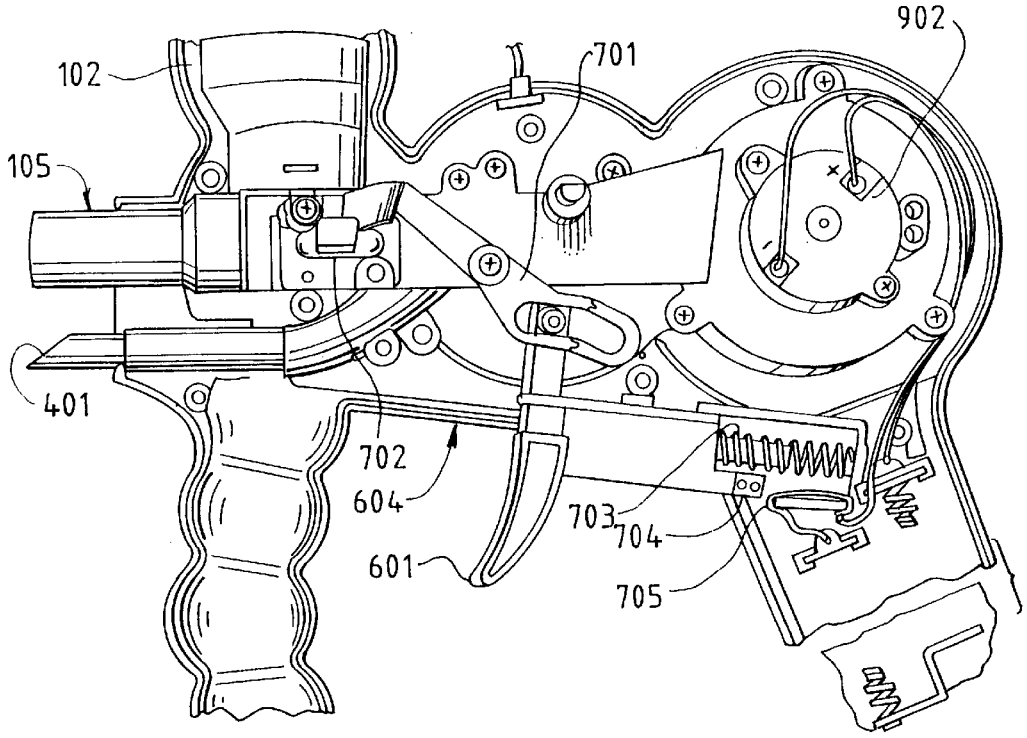
FIG. 7 is an interior section view taken along section lines 7—7 of FIG. 6.

FIG. 7 is an interior section view taken along section lines 7—7 of FIG. 6 that illustrates the position of the actuation mechanisms of the bubble making apparatus when the trigger 601 is in its rest position. The trigger 601 is adapted to slide along mating features of the housing that are not visible in FIG. 7, and the trigger 601 is biased into its rest position by a spring 703. An electrical contact 704 is disposed along the trigger mechanism, the electrical contact 704 designed to mate with a pair of electrical terminals 705 to complete an electrical circuit in a fashion to be discussed below.

The trigger also serves to operate the mechanism that dispenses bubble solution into the bubble forming chamber. A linkage 701 is pivotally mounted through an appropriate housing boss such that the linkage 701 communicates with a portion of the trigger 601 at a first end, and with activating arm 702 at a second end.

Figure 8:
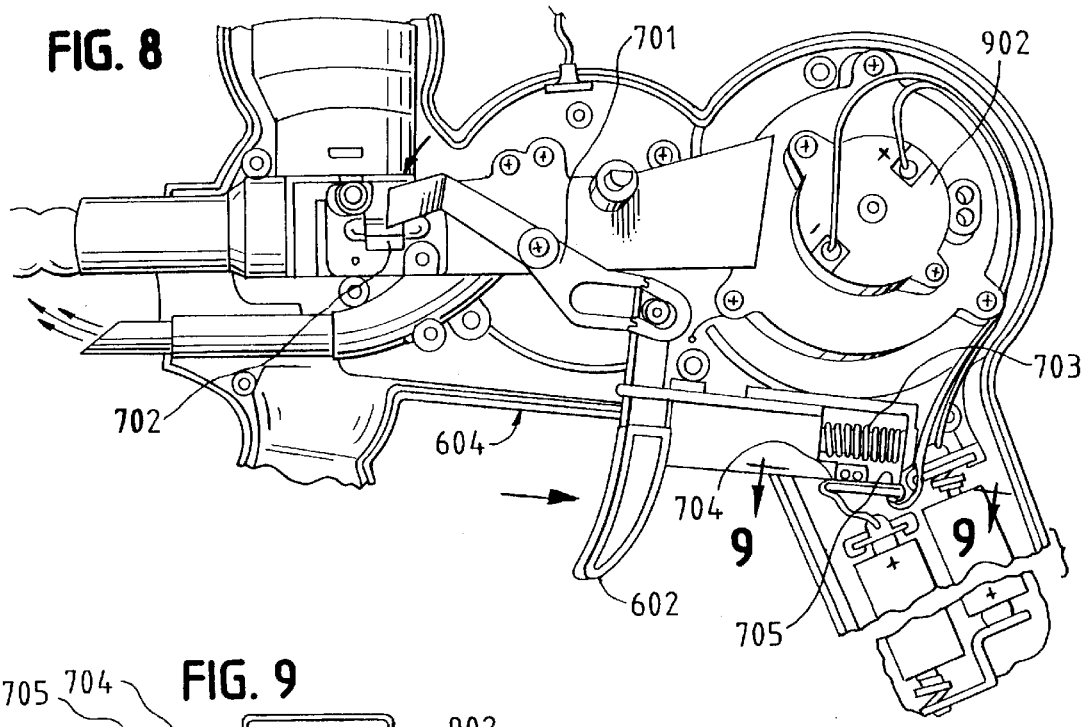
FIG. 8 is another interior section view of the bubble making apparatus of FIG. 6.

FIG. 8 illustrates the operation of the bubble making apparatus as the trigger is squeezed and translated to its second position 602. As the trigger is drawn back, the linkage 701 pivots such that the end of the linkage 701 nearest the activating arm 702 moves the activating arm 702 downward. This movement of the activating arm 702 dispenses bubble forming solution from the bubble forming solution reservoir into the bubble forming chamber in a manner that will be described below.

Figure 9:
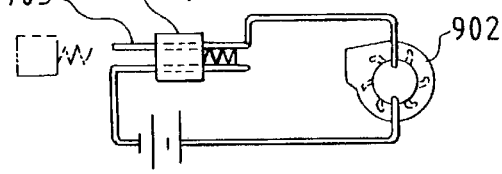
FIG. 9 is a schematic diagram of electrical components of the bubble making apparatus in accordance with the present invention.

The movement of the trigger into its second position 602 also allows the electrical contact 705 to touch the electrical terminals 705 and complete the electrical circuit from the battery 901 to the fan 902. A schematic diagram of this completed electrical circuit is illustrated in FIG. 9. In the preferred embodiment of the invention, the battery 901 comprises two 1.5 volt AA batteries.

Figure 10:
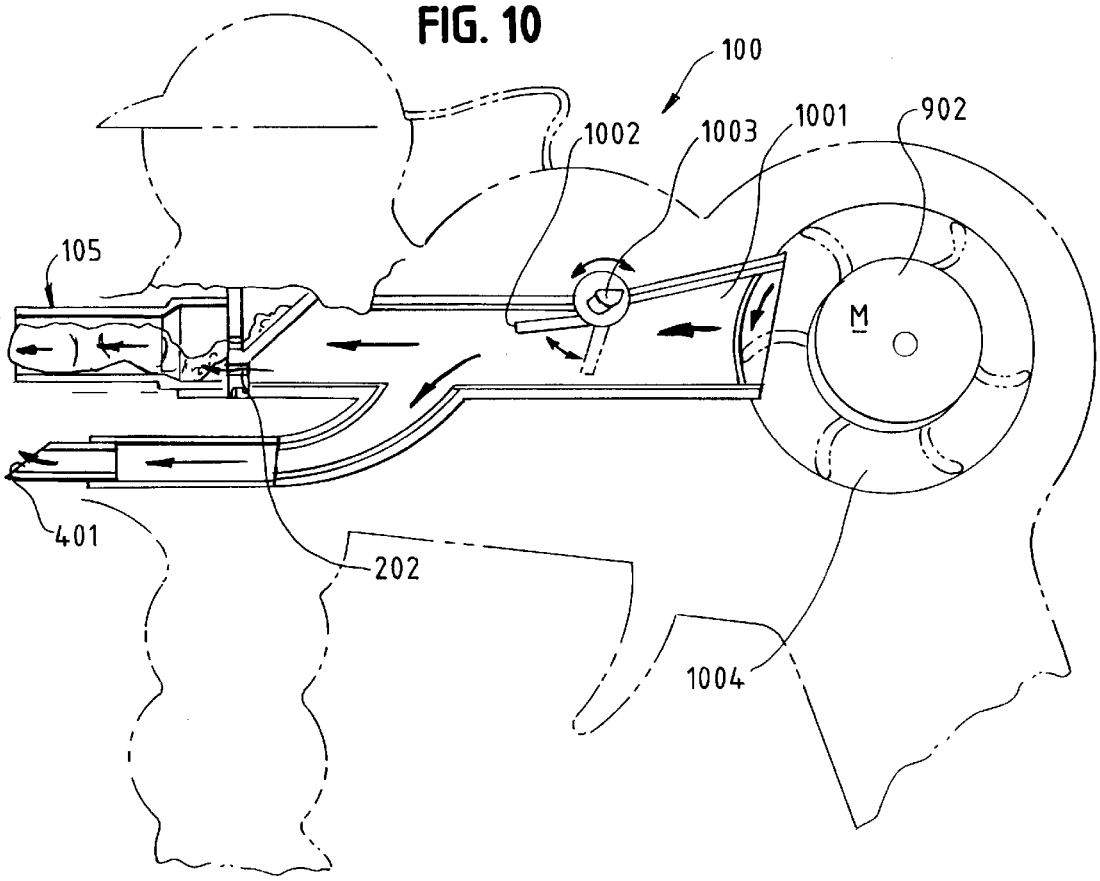
FIG. 10 is a partial interior section view illustrating air flow paths.

FIG. 10 is a section view of the air duct 1001 that provides air flow from the fan 902 to the bubble forming vents 202, bubble propulsion vents 301, and the air outlet port 401. The air duct 1001 is securely coupled to the fan housing 1004 to minimize loss of air flow, and directs the air flow from the fan past a regulating vane 1002 and into a primary air path leading to the bubble forming vents 202 and bubble propulsion vents 301, and a secondary path leading to the air outlet port 401.

The regulating vane 1002 helps to regulate overall air flow through the air duct 1002 so that the bubble making apparatus is useful over a range of battery voltages. The regulating vane 1002 is a pivotally mounted rectangular panel that spans substantially the entire width of the air duct 1001, and can be rotated through a range of positions from an open position substantially parallel to the air flow through the air duct 1001 to a closed position substantially perpendicular to the air flow. When the batteries are at full capacity, the regulating vane 1002 is rotated toward its closed position to prevent too much air flow from being delivered. As the batteries weaken through use, the regulating vane 1002 is then rotated toward its open position, via an easily accessible exterior knob 605 (FIG. 6), to permit greater air flow, thus extending the useful life of the batteries used to power the apparatus.

Figure 11:
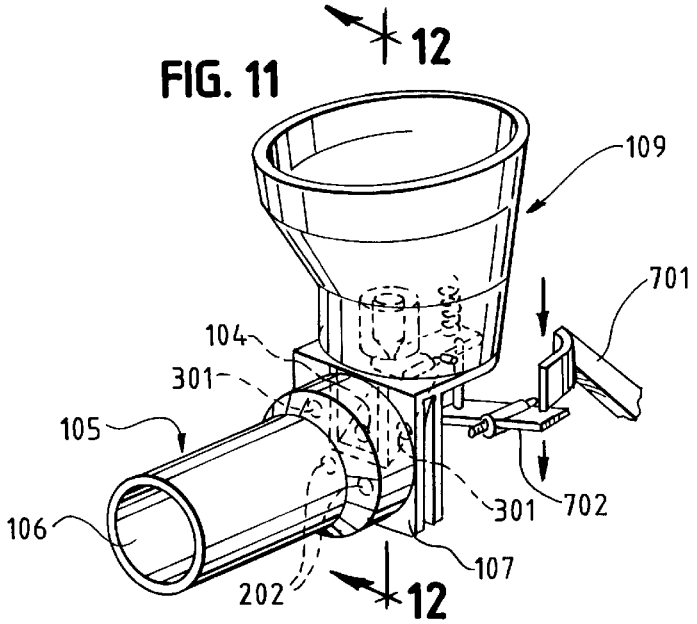
FIG. 11 is a left front perspective view of the bubble solution reservoir assembly and bubble forming tube.

FIG. 11 is a left front perspective view of the bubble solution reservoir assembly 109 and bubble forming tube 105, showing some of the interior details in dashed lines so that operation of the device can more clearly be visualized. In particular, FIG. 11 illustrates the locations of the bubble forming vents 202 and bubble propulsion vents 301 in the front wall 107 of the bubble solution reservoir assembly 109 with respect to the bubble solution feed aperture 104.

In addition, FIG. 11 shows a portion of the mechanism that releases bubble forming solution from the bubble solution reservoir into the bubble forming chamber. The end of the linkage 701 distal from the trigger mechanism is shown proximate to the activating arm 702.

Figure 12:
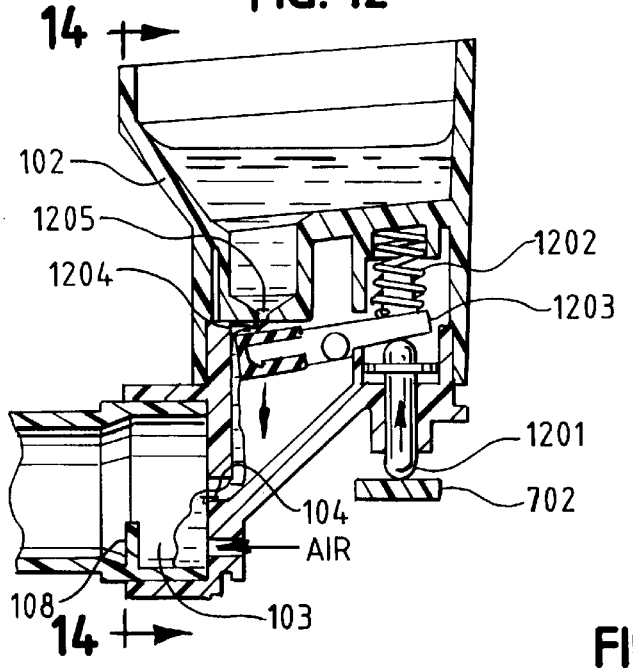
FIG. 12 is a section view taken along section lines 12—12 of FIG. 11.

In FIG. 12, which is a section view taken along section lines 12—12 of FIG. 11, additional details of the bubble solution release mechanism can be seen. The end of the activating arm 702 that is distal from the linkage 701 is moved into contact with a push rod 1201, the push rod 1202 being biased against a downward stop by the action of a spring 1202. As the push rod 1201 moves upward through the action of the activating arm 702, the push rod 1201 contacts a valve control arm 1203 that is pivotally mounted and biased into a closed position against a valve body 1204 that effectively seals the opening 1205 in the bottom of the bubble solution reservoir 102.

In the position shown in FIG. 12, the push rod 1201 has been moved upward by operation of the linkage 701 against the activating arm 702. The valve control arm 1203 has thus been pivoted downward at the end proximate to the bubble solution reservoir 102, thus allowing the valve body 1204 to release bubble solution into the bubble forming chamber 103 via the bubble solution feed aperture 104.

Figure 13:
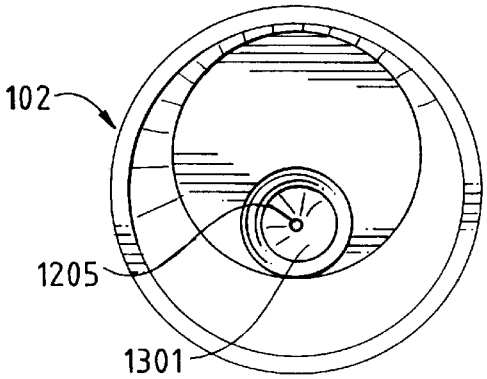
FIG. 13 is a top view of the bubble solution reservoir.

FIG. 13 is a top view of the bubble solution reservoir 102 illustrating the position of the opening 1205 in the bottom of the bubble solution reservoir 102. The opening 1205 is positioned inside a sump 1301 in the reservoir 102 that helps to ensure that virtually all of the bubble solution in the reservoir is usable during operation of the bubble making apparatus.

Figure 14:
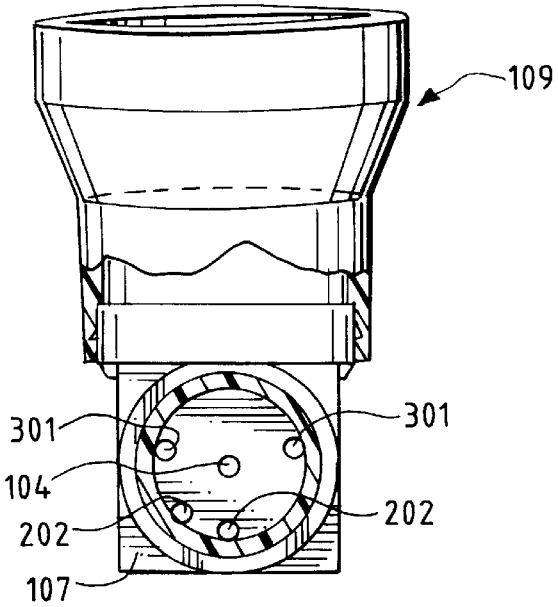
FIG. 14 is a front section view of the bubble solution reservoir assembly taken along section lines 14—14 of FIG. 12.

FIG. 14 is a front section view of the bubble solution reservoir assembly 109 taken along section lines 14—14 of FIG. 12. This view of the bubble solution reservoir assembly 109 more accurately depicts the relative positions of the bubble solution feed aperture 104, the bubble forming vents 202, and the bubble propulsion vents 301 in the front wall 107 of the bubble solution reservoir assembly 109.

There have been described herein a bubble making apparatus and method that are relatively free from the shortcomings of the prior art. It will be apparent to those skilled in the art that modifications may be made without departing from the spirit and scope of the invention. Accordingly, it is not intended that the invention be limited except as may be necessary in view of the appended claims.

What is claimed is:

1. A bubble making apparatus comprising:

a bubble conveying tube having a bubble outlet port through which a continuous chain of connected bubbles is adapted to be expelled;

a fan for generating a stream of air; and an air outlet port separate from and positioned below the outlet port of the bubble conveying tube through which air outlet port a stream of air generated by said fan is directed substantially parallel to the direction in which said bubbles are adapted to be expelled from the bubble conveying tube;

such that the chain of connected bubbles is supported by the stream of air from the air outlet port as they exit from the bubble outlet port.

2. The bubble making apparatus of claim 1, wherein the bubble conveying tube includes a bubble forming chamber at a first end and said bubble outlet port at a second end.

3. The bubble making apparatus of claim 2, wherein the bubble forming chamber is defined at least in part by a transverse partition in the bubble forming tube.

4. The bubble making apparatus of claim 1, wherein the fan is driven by an electric motor.

5. The bubble making apparatus of claim 4, wherein the electric motor is battery powered.

6. A bubble making apparatus comprising:

a bubble forming tube having a bubble forming chamber at a first, proximal end, and a bubble outlet port at a second, distal end, through which a chain of connected bubbles is expelled;

a bubble solution reservoir operatively connected to the bubble forming chamber via a bubble solution feed aperture;

a fan coupled to an air duct, the air duct communicating with the bubble forming chamber via bubble forming vents;

a plurality of bubble propulsion vents in communication with the air duct;

an air outlet port positioned below the bubble forming tube through which a stream of air is directed substantially parallel to the bubble forming tube and in the direction of bubble expulsion;

such that a chain of connected bubbles is expelled from the bubble outlet port via air flow through the bubble forming vents and bubble propulsion vents, and the chain of connected bubbles is supported by the stream of air from the air outlet port upon exit from the bubble outlet port.

7. The bubble making apparatus of claim 6, wherein the bubble forming chamber is defined at least in part by a transverse partition in the bubble forming tube.

8. The bubble making apparatus of claim 7, wherein the bubble forming vents are disposed below and adjacent to the bubble solution feed aperture.

9. The bubble making apparatus of claim 6, wherein a control valve is interposed between the bubble solution reservoir and the bubble forming chamber.

10. The bubble making apparatus of claim 6, wherein the fan is driven by an electric motor.

11. The bubble making apparatus of claim 10, wherein the motor is battery powered.

12. A method for producing a chain of connected bubbles, the method comprising the steps of:

(a) providing a bubble forming tube having a bubble forming chamber at a first end in communication with a bubble solution reservoir via a bubble solution feed aperture, and a bubble outlet port at a second end;

(b) providing bubble forming vents into the bubble forming chamber through which air is directed to form connected bubbles within the bubble forming tube;

(c) providing a plurality of bubble propulsion vents in communication with the bubble forming tube such that a chain of connected bubbles is expelled from the bubble outlet port; and (d) providing an air outlet port positioned below the bubble forming tube through which a stream of air is directed, such that the chain of connected bubbles is supported by the stream of air from the air outlet port upon expulsion from the bubble outlet port.

13. The method in accordance with claim 12, wherein the step of providing bubble forming vents into the bubble forming chamber comprises providing two openings into the bubble forming chamber disposed below and adjacent to the bubble solution feed aperture.

14. The method in accordance with claim 12, wherein the step of providing a plurality of bubble propulsion vents in communication with the bubble forming tube comprises providing two openings adjacent and above the bubble solution feed aperture, the openings in communication with a fan via an air duct, such that streams of air are directed through the openings to aid in expelling a chain of connected bubbles from the bubble outlet port.

15. A bubble making apparatus comprising:

a bubble forming tube having a bubble outlet port through which a chain of connected bubbles is expelled;

an air outlet port positioned below the bubble forming tube through which a stream of air is directed substantially parallel to the bubble forming tube and in the direction of bubble expulsion;

such that the chain of connected bubbles is supported by the stream of air from the air outlet port upon exit from the bubble outlet port; and wherein the bubble forming tube includes a bubble forming chamber at a first end and a bubble outlet port at a second end, said bubble forming chamber being defined at least in part by a transverse partition in the bubble forming tube, said transverse partition comprising a plate disposed within the bubble forming tube.

16. A bubble making apparatus comprising:

means for forming bubbles proximate to a first end of a bubble forming tube;

means for expelling a chain of connected bubbles from a second end of the bubble forming tube; and means for supporting the chain of connected bubbles upon expulsion comprising an air outlet port positioned below the bubble forming tube through which a stream of air is directed, such that the chain of connected bubbles is supported by the stream of air from the air outlet port upon expulsion.

* * * * *